US005218907A

United States Patent [19]

Komori et al.

[11] Patent Number: 5,218,907

[45] Date of Patent: Jun. 15, 1993

[54] PLATE EXCHANGE APPARATUS FOR PRINTING PRESS

[75] Inventors: Ichiro Komori, Tokyo; Hiroyuki Sugiyama, Ibaraki, both of Japan

[73] Assignee: Komori Corporation, Japan

[21] Appl. No.: 623,605

[22] Filed: Dec. 7, 1990

[30] Foreign Application Priority Data

Dec. 15, 1989 [JP] Japan ..... 1-323934

[51] Int. Cl.[5] ..... B41F 27/06; B41L 29/16

[52] U.S. Cl. ..... 101/415.1; 101/477

[58] Field of Search ..... 101/212, 216, 415.1, 101/378, 382.1, 477, 130, 132, 132.5, 141, 142, 54; 33/618

[56] References Cited

U.S. PATENT DOCUMENTS

| | | | |
|---|---|---|---|
| 3,793,950 | 2/1974 | Kaneko et al. | 101/141 X |
| 3,858,513 | 1/1975 | Murata | 101/415.1 |
| 4,191,105 | 3/1980 | Ohlsson | 101/132 X |
| 4,417,514 | 11/1983 | Hoshino | 101/54 |
| 4,727,807 | 3/1988 | Suzuki et al. | 101/415.1 |

FOREIGN PATENT DOCUMENTS

| | | | |
|---|---|---|---|
| 777000 | 1/1968 | Canada | 101/415.1 |
| 2804970 | 8/1978 | Fed. Rep. of Germany . | |
| 0022755 | 2/1984 | Japan | 101/415.1 |
| 0191636 | 8/1988 | Japan | 101/415.1 |

OTHER PUBLICATIONS

Patent Abstracts of Japan, vol. 11, No. 196 (M-601) (2643) Jun. 24, 1987 & JP-A-62 19 458 Akiyama Insatsuki Seizo KK, Jan. 28, 1987.

*Primary Examiner*—J. Reed Fisher

*Attorney, Agent, or Firm*—Blakely, Sokoloff, Taylor & Zafman

[57] ABSTRACT

A plate exchange apparatus for a printing press having one fixing unit for fixing one end of a plate and the other fixing unit for fixing the other end of the plate wound around the circumferential surface of a plate cylinder, one fixing unit and the other fixing unit being arranged in a gap in the circumferential surface of the plate cylinder, includes a plate holding apparatus, an old plate holding apparatus, and a new plate holding apparatus. The plate holding apparatus holds an old plate to be removed and a new plate to be supplied. The old plate removal member is arranged in a plate removal path of the old plate which is released from the fixing units and which is removed into the plate holding apparatus upon pivotal movement of the plate cylinder. The old plate removal member holds and moves the old plates one by one every plate replacement cycle and stacks and stores the old plates in the plate holding apparatus. The new plate holding apparatus holds and moves the new plates stacked and stored in the plate holding apparatus and inserts each new plate into one fixing unit in an open state.

4 Claims, 9 Drawing Sheets

PLATE EXCHANGE APPARATUS FOR PRINTING PRESScl BACKGROUND OF THE INVENTION

The present invention relates to a plate exchange apparatus for holding old and new plates outside a plate cylinder when the old plate mounted on the plate cylinder is to be replaced with the new plate.

A leading-side lockup device serving as one fixing unit for gripping the leading edge of the plate and a trailing-side lockup device serving as the other fixing unit for gripping the trailing edge of the plate is fixed in a gap formed in the circumferential surface of the plate cylinder in a printing press to extend in the axial direction of the plate cylinder. Each of the conventional leading- and trailing-side lockup devices comprises an elongated lockup table extending in the axial direction of the plate cylinder, a plurality of gripper plates, swingably supported at an edge portion of this lockup table by a plurality of bolts, for gripping or releasing the plate with or from the lockup table, and a plurality of cams which can be respectively engaged with gaps at the edges of the gripper plates. The plurality of cams are aligned along a pivotal cam shaft. A plurality of compression coil springs are interposed between the lockup table and the gripper plates to bias the gripper plates in an open direction.

With the above arrangement, when a cam shaft of the leading-side lockup device is pivoted, the gripper plates which are divided in the axial direction of the plate are released upon disengagement from the cams and are simultaneously opened by the elastic forces of the compression coil springs. An end of the plate is inserted between the leading-side lockup device and the corresponding lockup table. When the cam plate is pivoted in the direction opposite to the direction described above, the gripper plates are pivoted against the elastic forces of the compression coil springs by the behavior of the cams and are closed, thereby gripping the leading edge of the plate.

Another conventional apparatus is disclosed in Japanese Patent Laid-Open No. 1-127346. In this apparatus, the lockup tables and the gripper plates are disposed in the radial direction of a plate cylinder so that a trailing-side gripper surface of the plate conventionally formed in the circumferential direction of the plate cylinder is formed in the radial direction of the plate cylinder. The edge of the plate is bent at a right angle by an external bending machine. With this arrangement, after the leading edge of the plate is gripped, the trailing-edge bent portion of the plate wound around the circumferential surface of the plate is inserted between the lockup tables and the gripper plates. The gripper plates are swung by a cam mechanism to grip the bent portion of the plate. The trailing-side lockup device as a whole is circumferentially moved to uniformly mount the plate, thereby bringing the plate into tight contact with the surface of the plate cylinder.

In such a conventional press, when an old plate is replaced with a new plate due to changes in contents of printed matters, the trailing-side cam shaft is pivoted to open the trailing-side lockup device. One end of the plate which is released from gripping is kept held, and the plate cylinder is rotated. The leading-side cam shaft is pivoted to open the leading-side lockup device to release the other end of the plate from gripping, thereby removing the old plate. Thereafter, opening/closing of the plate lockup devices and the pivotal operation of the plate cylinder are repeated to mount the new plate.

In plate replacement in the conventional printing press, however, pivotal movement of the cam shaft and rotation of the plate cylinder must be performed manually or upon operation of a push button. Plate replacement is cumbersome and requires skills since the old and new plates must be manually held. In addition, the new plate cannot be placed to stand by at a mounting position of the plate cylinder during printing. The old plate must be removed from the press during the replacement. A preparation period is therefore undesirably prolonged, and productivity is degraded. In addition, automatic plate replacement cannot be performed due to a requirement of plate holding.

SUMMARY OF THE INVENTION

It is an object of the present invention to provide a plate exchange apparatus for a printing press, capable of greatly reducing labor, performing fully automatic plate replacement, eliminating a requirement for skills on the side of an operator, achieving energy savings, shortening preparation time, and improving productivity.

It is another object of the present invention to provide a plate exchange apparatus for a printing press, capable of allowing a continuous operation for replacing a plurality of plates and further shortening the preparation time and improving the productivity.

In order to achieve the above objects of the present invention, there is provided a plate exchange apparatus for a printing press having one fixing unit for fixing one end of a plate and the other fixing unit for fixing the other end of the plate wound around a circumferential surface of a plate cylinder, one fixing unit and the other fixing unit being arranged in a gap in the circumferential surface of the plate cylinder, comprising a plate holding apparatus for holding an old plate to be removed and a new plate to be supplied, an old plate removal member, arranged in a plate removal path of the old plate released from the fixing units and removed into the plate holding apparatus upon pivotal movement of the plate cylinder, for holding and moving the old plates one by one every plate replacement cycle and for stacking and storing the old plates in the plate holding apparatus, and a new plate holding apparatus for holding and moving the new plates stacked and stored in the plate holding apparatus and inserting each new plate into one fixing unit in an open state.

In plate replacement, a plurality of new plates are held by the plate holding apparatus during printing, and the plate cylinder which is in rolling contact with a blanket cylinder is stopped at a plate removal position. When both the leading- and trailing-side plate fixing units are released, and the plate cylinder is rotated, the old plate is inserted into the plate holding apparatus. At this time, the old plate removal member holds the old plate and is moved at almost the same peripheral speed as that of the plate cylinder, so that the old plate is stored in the plate holding apparatus. When the new plate holding apparatus holds the uppermost new plate and is moved after the plate cylinder is rotated to an angular position where the distal end portion of the plate holding apparatus corresponds to one fixing unit, one fixing unit holds one end of the new plate. The plate cylinder is then rotated by almost one revolution, and the other end portion of this new plate is fixed by the other fixing unit, thereby mounting the new plate on the plate cylinder. Thereafter, the above operations are repeated every time the specifications of the printed matters are changed. The plurality of new plates are fed to the plate cylinder one by one and are used up. At the same time, the plurality of old plates are stacked and stored in the plate holding apparatus. These old plates are removed during printing, and next new plates are prepared and stored in the plate holding apparatus, thereby allowing continuous printing operations.

BRIEF DESCRIPTION OF THE DRAWINGS

FIGS. 1 to 10H show an embodiment of a plate holding unit according to the present invention, in which FIG. 1 is a plan view of a plate cylinder which employs the plate holding unit, FIG. 2 is a sectional view of the plate cylinder along the line II—II in FIG. 1, FIG. 3 is a sectional view of the plate cylinder along the line III—III in FIG. 1, FIG. 4 is a sectional view of the plate cylinder along the line IV—IV in FIG. 1;

FIG. 5 is a sectional view of the plate cylinder along the line V—V in FIG. 1, FIG. 6 is a longitudinal sectional view of a trailing-side plate lockup device before a plate is gripped, FIG. 7 is a side view of a plate lockup opening/closing unit, FIG. 8 is a side view showing the plate exchange apparatus and components around the plate cylinder;

FIG. 9 is an enlarged front view of the plate lockup opening/closing unit; and FIGS. 10A to 10H are schematic side views showing the plate replacing apparatus and the main part to explain plate replacement operations.

DESCRIPTION OF THE PREFERRED EMBODIMENT

Figure 1:
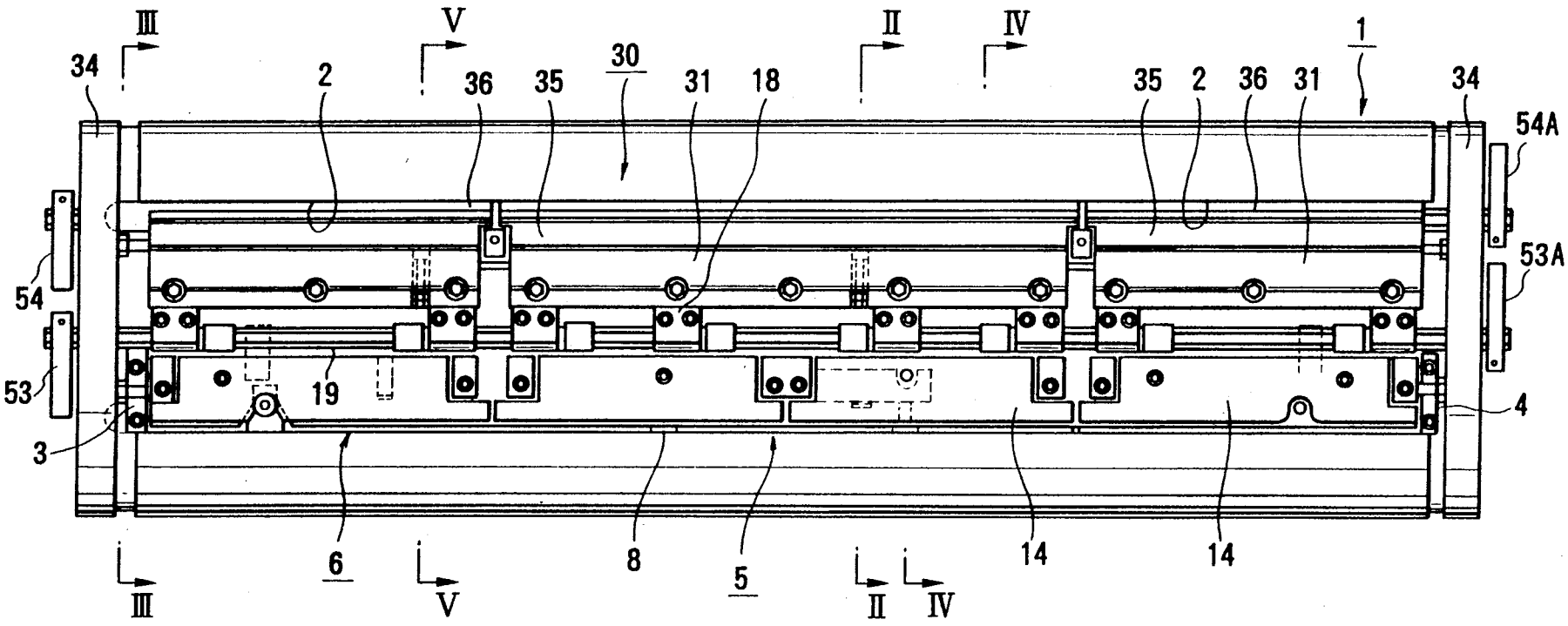
Figure 2:
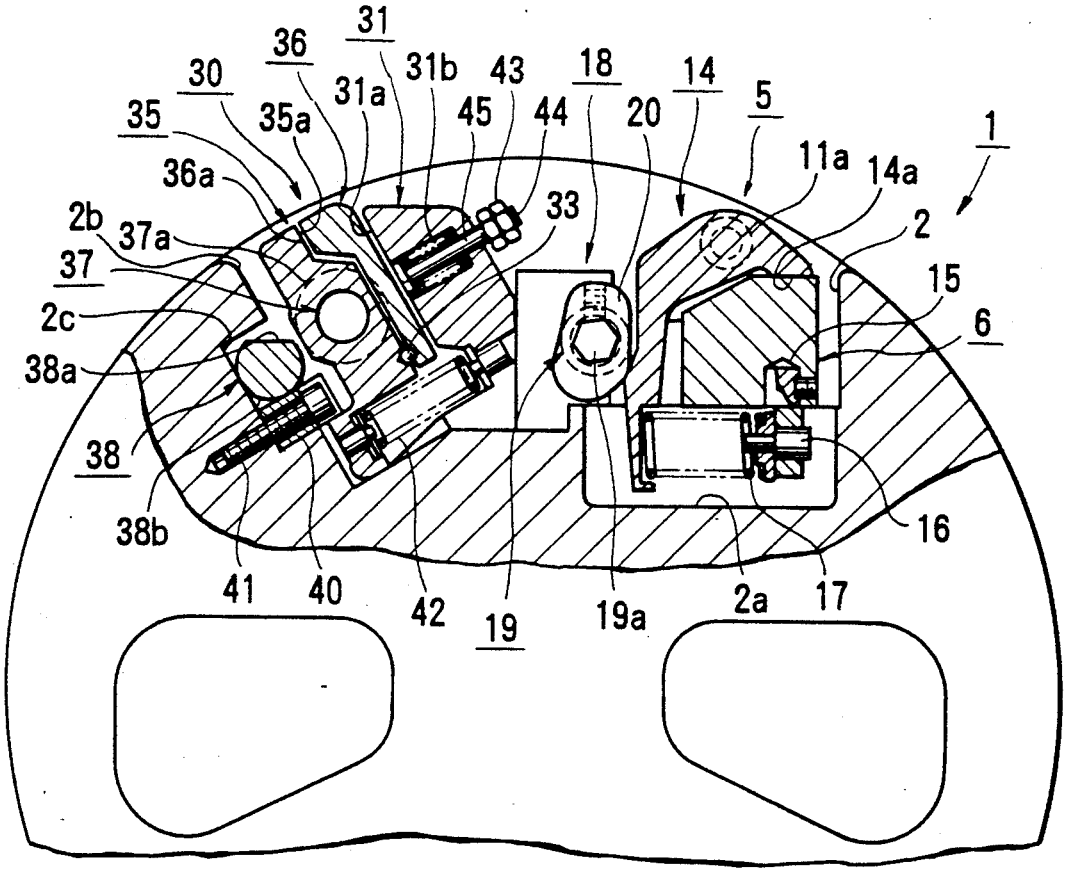
Figure 3:
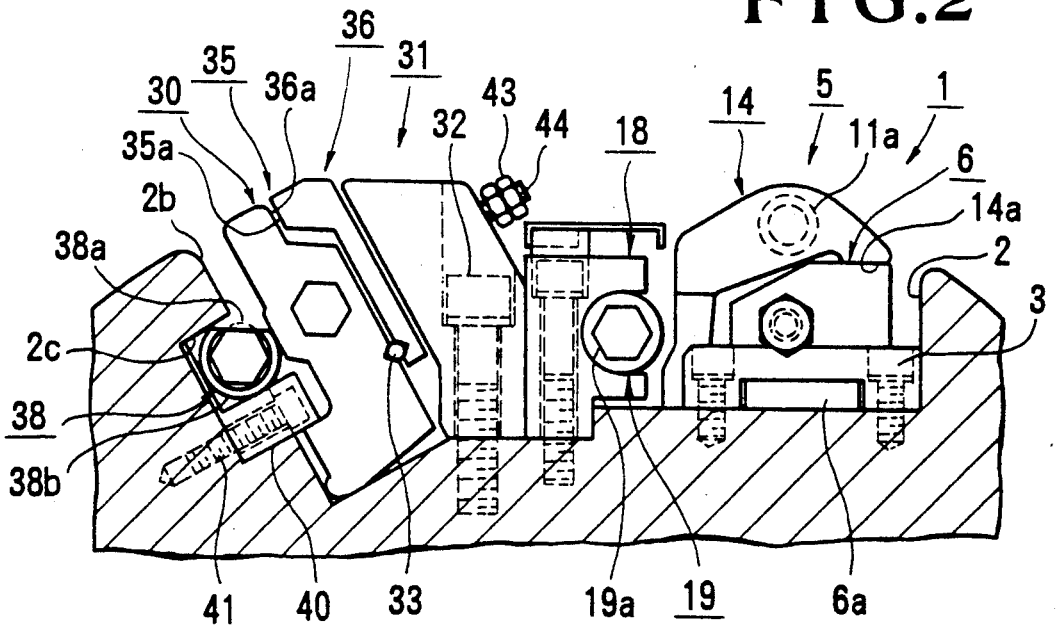
Figure 4:
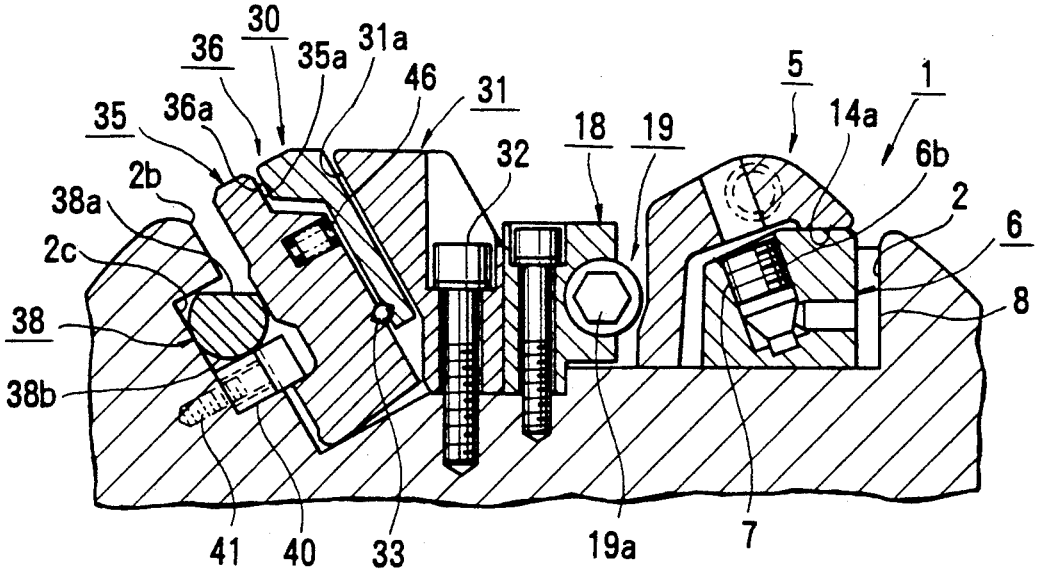

FIGS. 1 to 10H show an embodiment in which a plate exchange apparatus according to the present invention is employed in an automatic plate replacing apparatus.

A gap 2 is formed in the outer circumferential surface of a plate cylinder 1 along the entire length of the plate cylinder 1. Saddle-like guides 3 and 4 are bolted on the bottom surface portions of the gap 2 at its two ends. A leading-side plate lockup device 5 comprises a lockup table 6 having an almost square sectional shape and extending in the axial direction of the plate cylinder. Thin-walled portions **6*a* at the two ends of the lockup device 6 are fitted to be slightly circumferentially movable while their vertical movement is restricted by the left and right guides 3 and 4. A plurality of screw holes 6*b* are formed in portions along the longitudinal direction of the lockup table 6 and each has a section shown in FIG. 4. An adjusting screw 7 whose distal end is tapered is theadably engaged with a corresponding one of the screw holes 6*b*. A collared pin 8, the collar portion of which is fitted between the lockup table 6 and the gap 2, is slidably inserted in each pin hole corresponding to each of the adjusting screws 7. The distal end of the collared pin 8 abuts against a tapered surface of the corresponding adjusting screw 7. With this arrangement, when the adjusting screw 7 is turned, the lockup table 6 is slightly moved in the circumferential direction by the behavior of the tapered surface. A compression coil spring 9 in FIG. 5 is inserted between a stud 10 on the lockup table 6 and the wall surface of a recessed hole 2*a* of the gap 2 to bias the lockup device 5** outward.

Figure 5:
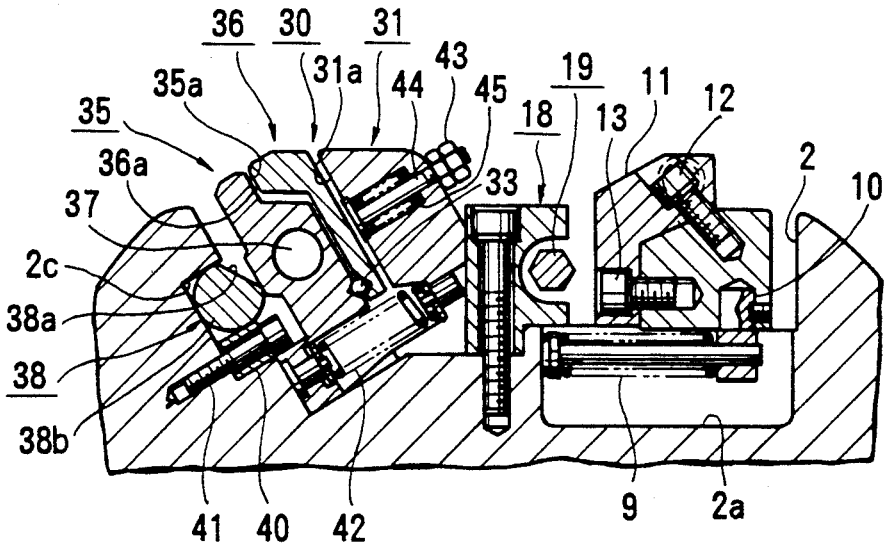
Figure 6:
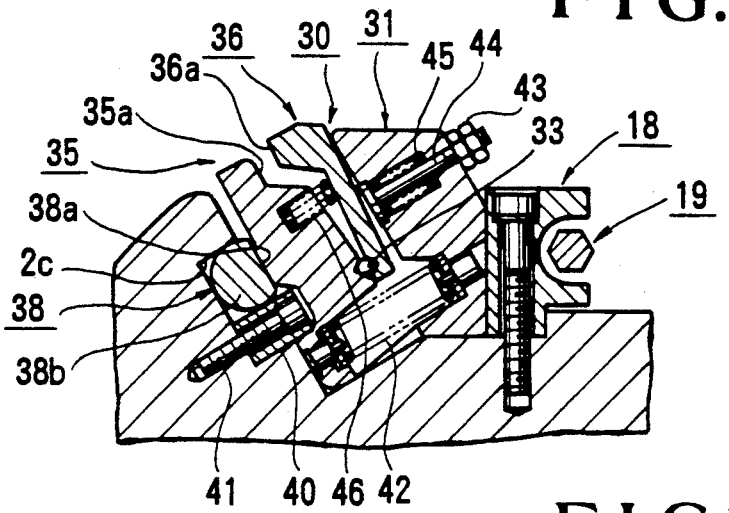

An L-shaped leading-side plate holder 11 shown in FIG. 5 is fixed by bolts 12 and 13 on the inclined surface of the lockup table 6. Three gripper plates 14 having a substantially V-shaped section, divided in the axial direction of the plate cylinder, and constituting the same overall length as that of the lockup table 6 are swingably supported on pins **11*a* horizontally extending from the plate holders 11. A gripper surface 14*a* of each gripper plate 14 opposes the gripper surface of the lockup table 6. A plurality of studs 15 each having a sectional shape shown in FIG. 2 extend upward from the bottom surface of the lockup table 6 and are aligned in the axial direction of the plate cylinder to extend into the recessed hole 2*a* of the gap 2. A compression coil spring 17 is inserted between a spring reception pin 16 threadably engaged with a screw hole of each stud 15 and the gripper plate 14 to bias the gripper plate 14 in a direction so that the gripper surface 14*a* of the gripper plate 14** is closed.

A plurality of bearings 18 having a rectangular parallelepiped shape are fixed by bolts at the central part of the bottom surface of the gap 2 and are aligned along the axial direction of the plate cylinder. A hexagonal cam shaft 19 is fitted in the bearings 18. A plurality of plate gripper cams 20 each having large- and small-diameter portions are mounted on the cam shaft 19 in tandem with each other. The cam surface of each plate gripper cam 20 is in contact with a vertical surface of the corresponding gripper plate 14. Upon driving of the cam shaft 19 by a drive unit (to be described later), the large-diameter portions of the plate gripper cams 20 cause the gripper plates 14 to pivot in the counterclockwise direction against the biasing forces of the compression coil springs 17, so that the gripper surfaces **14*a*** are opened.

A trailing-side plate lockup device 30 is arranged parallel to the leading-side lockup device 5 within the gap 2. The trailing-end lockup device 30 comprises a spring reception bar 31 having almost the same length as the overall length of the plate cylinder and a vertical surface which is in contact with the vertical surface of the corresponding bearing 18. The spring reception bar 31 is fixed on the bottom surface of the gap 2 by a plurality of bolts 32. The spring reception bar 31 comprises a regulation surface **31*a* extending in the radial direction of the plate cylinder 1. A support shaft 33 extends between the regulation surface 31*a* and a wall surface 2*b* of the gap 2 so that the two ends of the support shaft 33 are located near disc bearers 34 at the two ends of the plate cylinder 1. Three separated lockup tales 35 and three separating gripper plates 36 have opposite gripper surfaces 35*a* and 36*a* extending in the radial direction of the plate cylinder 1 so that ends of the lockup tables 35 and the gripper plates 36 opposite to these gripper portions are swingably connected to each other through the support shaft 33. Reference numerals 37 denote adjusting screws for connecting the three separated lockup tables 35. Right- and left-hand threads are threadably engaged with screw holes of each lockup table 35. A tool is inserted into a hole of a collar portion 37*a* integrally formed between the two adjacent lockup tables 35 and is turned to adjust a distance between the adjacent lockup tables 35**.

A rod-like cam 38 formed by a planar small-diameter portion 38*a* and an arcuated large-diameter portion 38*b* is pivotally mounted on the bearer 34 in a recessed portion 2*c* formed in the wall surface 2*b* of the gap 2. An extended portion 38*c* of the cam 38 from the bearer 34 has a hexagonal shape. Reference numeral 40 denotes a guide for pivoting the cam 38 and is fixed in the recessed portion 2*c* of the wall surface 2*b* by a bolt 41. Compression coil springs 42 are interposed between a plurality of spring hole bottom surfaces formed in the non-gripper ends of the lockup tables 35 and the plurality of spring hole bottom surfaces formed in the spring reception bar 31 to separate the lockup tables 35 from the spring reception bar 31. A compression coil spring 45 is interposed between the bottom surface of a spring hole 31*b* and a collar portion of a spring shaft 44 whose movement is limited by a double nut 43 slidably mounted in the spring hole 31*b* of the upper portion of the spring reception bar 31, and separates each gripper plate 36 from the spring reception bar 31. A compression coil spring 46 is arranged within the spring hole of the upper portion of each lockup table 35 to bias this lockup table 35 from the corresponding gripper plate 36. Reference numeral 47 denotes a blanket cylinder which is brought into rolling contact with the plate cylinder 1.

An opening/closing drive unit for pivoting the cam shaft 19 and the cam 38 to open/close each plate gripper surface will be described below. Each opening/closing drive unit is arranged near each of right and left frames 50 for supporting the plate cylinder 1 and the blanket cylinder 47. The right drive unit (the left-hand unit in FIG. 1 for illustrative convenience) on the right frame 50 when viewed from the sheet feeder will be described first. An air cylinder 51 serving as a drive unit is swingably supported on the upper end face of the frame 50 through a bracket 52. Levers 53 and 54 are split-fixed on the leading-side cam shaft 19 and the trailing side cam 38 between the bearer 34 and the frame 50. A link mechanism 55 is arranged between the air cylinder 51 and the levers 53 and 54. The distal end portion of a rod 57 connected to a piston rod 56 of the air cylinder 51 is connected to a free end portion of an L-shaped lever 59 pivotally supported on the upper surface of the frame 50 through a bracket 58. The lower end portion of a rod 60 whose upper end is connected to the other free end portion of the L-shaped lever 59 is connected to a free end portion of a lever 62 supported on a stud 61 of the frame 50. A lever 63 is formed integrally with the lever 62. A free end portion of the lever 63 is connected to one end of a roller lever 64. Reference numeral 65 denotes a lever shaft pivotally supported between the right and left frames so that axial movement of a lever 66 pivotally mounted thereon is limited. A free end portion of the lever 66 is supported by the central portion of the roller lever 64. That is, a four-joint link is constituted by the levers 63 and 66 and the roller lever 64. When the lever 62 is driven by the air cylinder 51 and is swung, the roller lever 64 is reciprocated together with the levers 63 and 66 in the radial direction of the plate cylinder 1. A roller 67 which is selectively brought into contact with the lever 53 or 54 in accordance with a pivotal phase of the plate cylinder 1 is mounted on the distal end portion of the roller lever 64. When the roller lever 64 is reciprocated, the lever 53 or 54 is pivoted about the cam shaft 19 or the cam 38 within the range between the solid line and the alternate long and short dashed line in FIG. 7.

In the right opening/closing drive unit, when the lever 53 is located at the position indicated by the solid line, the plate gripper surfaces of the leading-side lockup device 5 are closed. However, when the lever 54 is located at the position indicated by the solid line, the plate gripper surfaces of the trailing-side lockup device 30 are open.

Figure 7:
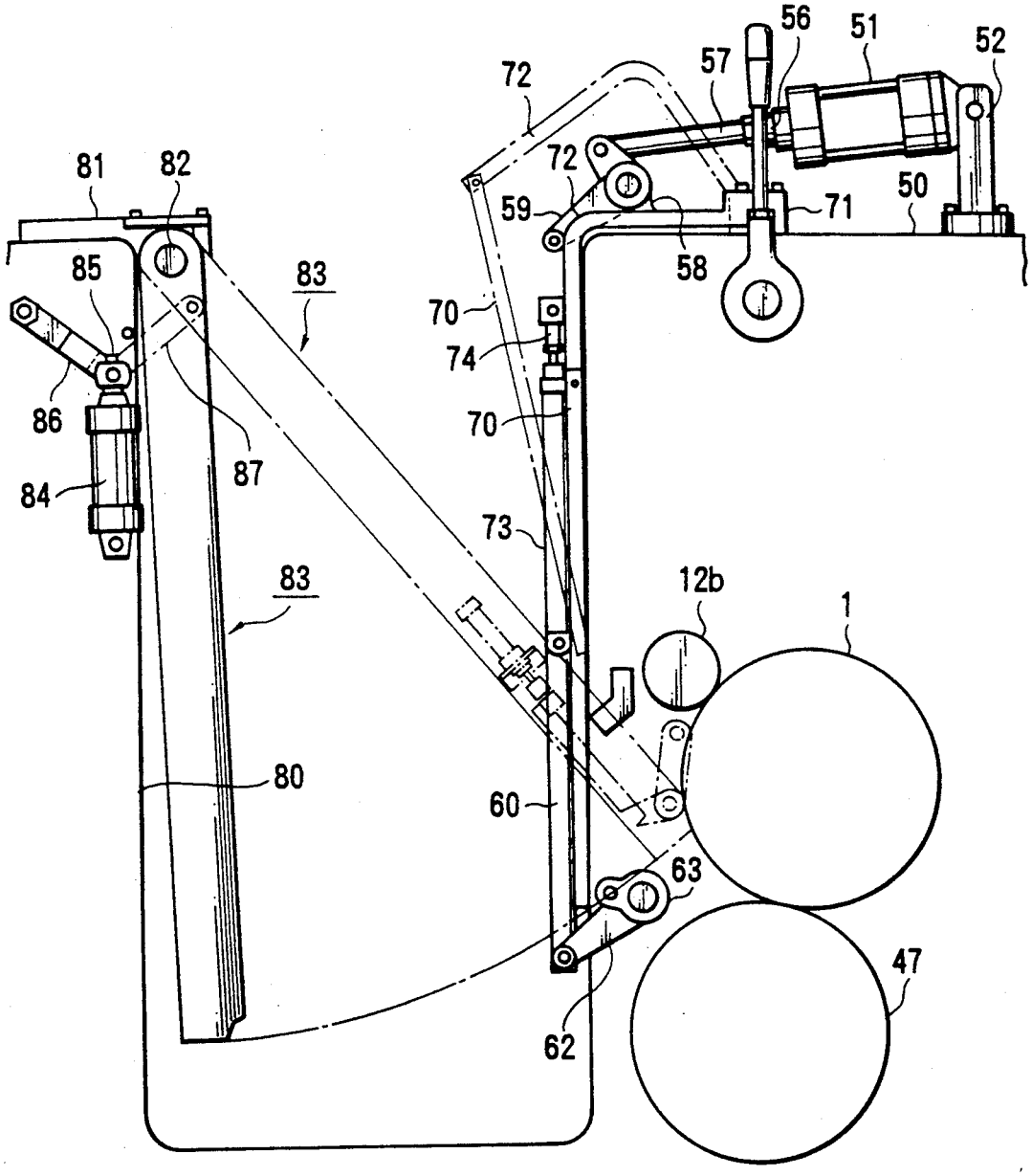
Figure 9:
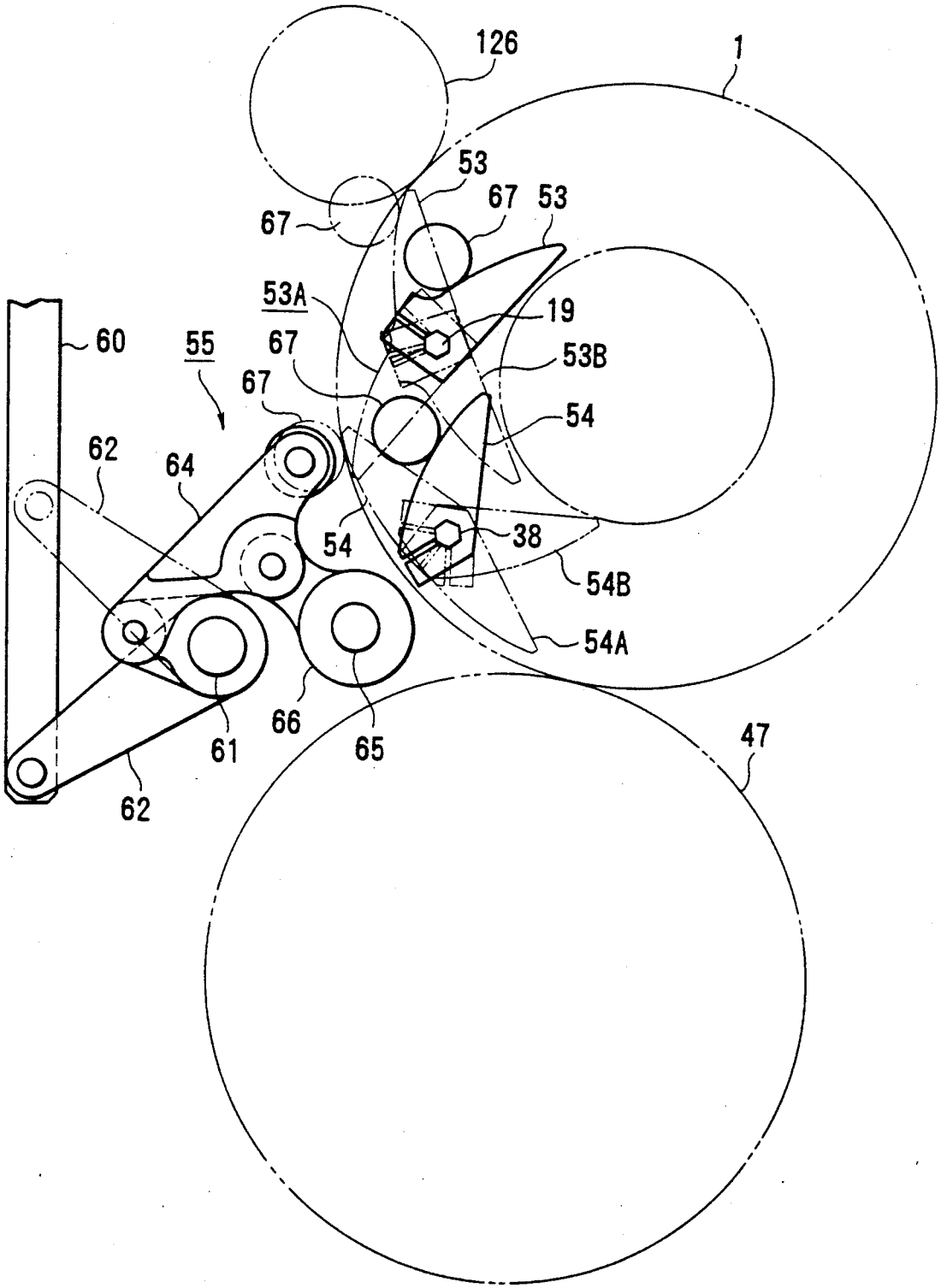

The left opening/closing drive unit (the right drive unit in FIG. 1) on the left frame side when viewed from the sheet feeder is arranged similarly to the right opening/closing drive unit, although the left opening/closing drive unit is not illustrated in FIG. 7. The arrangement of the left opening/closing drive unit is the same as that of the right opening/closing drive unit shown in FIG. 7 as far as the components from the air cylinder 51 to the roller 67 are concerned. The arrangement of the left opening/closing drive unit is different from that of the right opening/closing drive unit in levers 53 and 54. That is, as shown in FIGS. 1, 7, and 9, the right levers 53 and 54 extend upward from the cam shaft 19 and the cam 38. However, in the left opening/closing drive unit, levers 53A and 54A in FIGS. 1 and 9 extend downward from the cam shaft 19 and the cam 38. That is, the distal end portion of the right trailing-side lever 54 and the distal end portion of the left leading-side lever 53A are in phase in the circumferential direction and oppose the rollers 67. As a result, when the right and left air cylinders 51 are simultaneously actuated, the lever 54 is pressed by the right roller 67 to open the plate gripper surfaces of the trailing-side plate lockup device 30. At the same time, the left lever 53A is pressed by the left roller 67 and is moved to the position indicated by reference numeral 53B. The right lever 53 is moved to the position indicated by the alternate long and short dashed line, so that the plate gripper surfaces of the leading-side plate lockup device 5 are opened. Since the direction of the distal end of the right lever 53 is opposite to that of the distal end of the left lever 53A, when the right lever 53 is moved from the position indicated by the alternate long and short dashed line to the position indicated by the solid line, as shown in FIG. 9, the left lever 53A is moved from the position indicated by reference numeral 53B to the position indicated by the reference numeral 53A. When the left lever 54A is moved from the position indicated by reference numeral 54A to the position indicated by reference numeral 54B, the right lever 54 is moved from the position indicated by the solid line to the position indicated by the alternate long and short dashed line.

Reference numeral 70 in FIG. 7 denotes a cover for covering the front side of the plate cylinder 1 throughout its entire length. The cover 70 is pivotally supported on a free end portion of an L-shaped lever 72 pivotally supported on the upper end face of the frame 50 through a bracket 70. An actuation end of a piston rod 74 of an air cylinder 73 pivotally supported on the frame 50 is mounted on the L-shaped lever 72. With this arrangement, when the air cylinder 73 is actuated in response to a command from a control unit, the cover 70 is moved in the range of the position indicated by the solid line and the position indicated by the alternate long and short dashed line.

Figure 8:
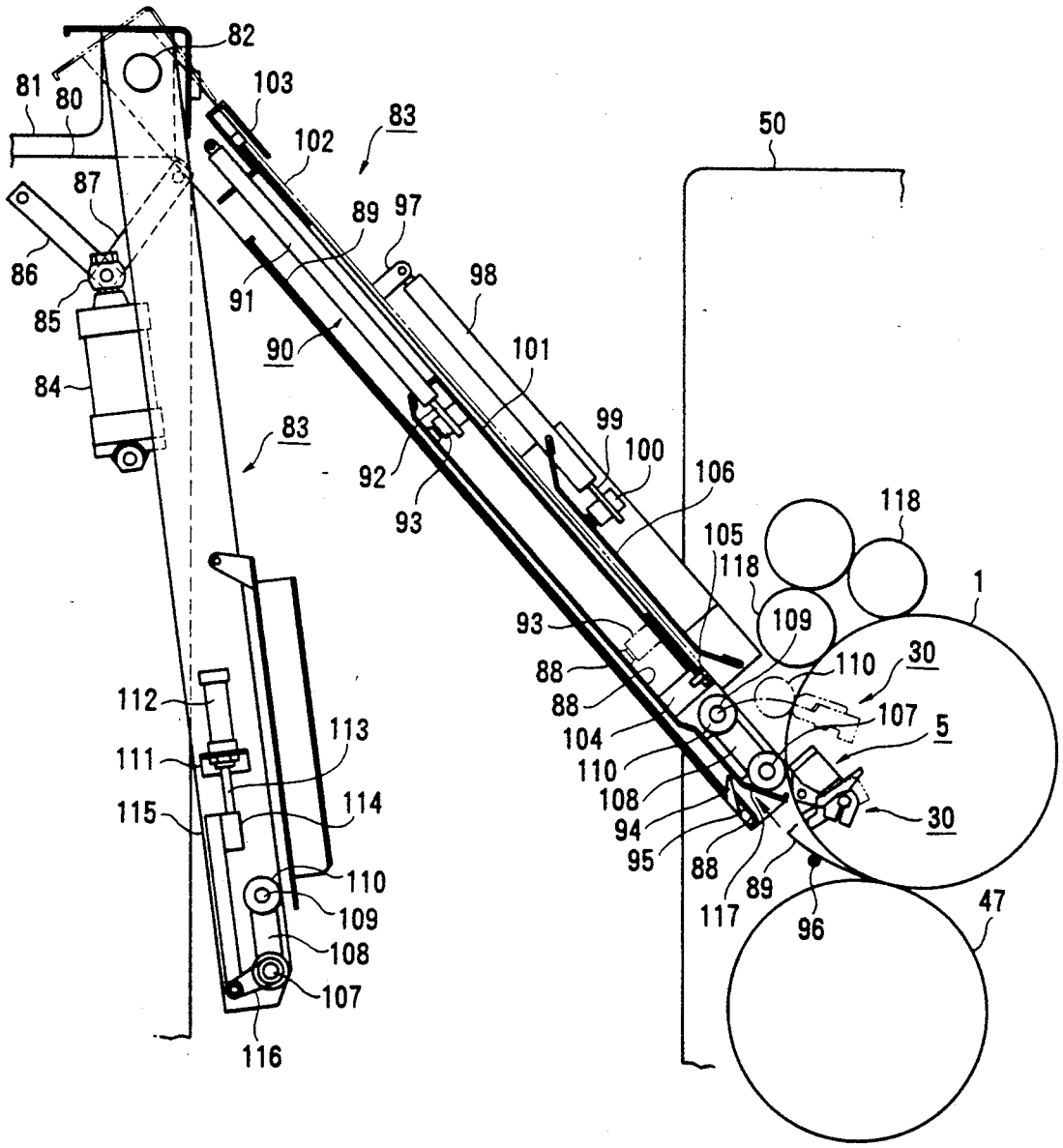

A plate replacing apparatus for replacing an old plate with a new plate is arranged in the plate lockup apparatus and the opening/closing unit. That is, a pair of right and left brackets 81 are located obliquely above the plate cylinder 1 and are mounted on the upper ends of the rear sides of right and left frames 80 mounted in a printing unit in front of the frames 50. The proximal end of a loader 83 serving as a plate holding apparatus having a rectangular member whose long sides are aligned in the horizontal direction and having almost the same length as the plate cylinder 1 is mounted on a support shaft 82 pivotally mounted on these brackets 81. An air cylinder 84 connected to the control unit is pivotally supported on the right and left frames 80 near the brackets 81. A lever 86 supported by the frame 80 and a lever 87 supported on the loader 83 are connected to an actuation end of a piston rod 85 of the air cylinder 84. With this arrangement, when the piston rod 85 of the air cylinder 84 is reciprocated, the loader 83 is swung through the levers 86 and 87 between a suspended position and an inclined position, so that the distal end portion of the loader 83 comes close to or is separated from the circumferential surface of the plate cylinder 1. As shown in FIG. 8, two guide plates 88 having a V-shaped inlet vertically extend in the lower half of the loader 83. When the plate lockup device 30 in the plate cylinder 1 stopped so that the trailing-side plate lockup device 30 opposes the lower end portion of the loader 83 is opened, a plate 89 released and rewound upon pivotal movement of the plate cylinder 1 is inserted between the guide plates 88 in a direction indicated by an arrow.

A pair of air cylinders 91 constituting an old plate suction member represented by reference numeral 90 are arranged in the upper half of the loader 83 so that the proximal end portions of the air cylinders 91 are pivotally supported on the inner surfaces of the two side plates of the loader 83. A plurality of suction pads 93 for engaging the old plate 89 entering between the guide plates 88 are aligned on a bar 92 connected to the piston rods of the air cylinders 91 and are connected to an air source (not shown). When the piston rod of each air cylinder 91 is reciprocated, the suction pads 93 are reciprocated between the illustrated solid line and the illustrated alternate long and short dashed line. The old plate 89 entering between the guide plates 88 is engaged at the position indicated by the alternate long and short dashed line and is moved to the position of the solid line, thereby storing the old plate 89 into the loader 83. This plate removal operation is repeated every time the specifications of printed matters are changed. The plurality of old plates 89 are stacked and stored in the loader 83. Reference numeral 94 denotes a stopper pivotally supported at the inlet of the guide plate 88 and biased clockwise by an elastic force of a compression coil spring 95. The old plate 89 causes the stopper 94 to pop against the elastic force of the compression coil spring 95 and is inserted between the guide plates 88. After the old plate 89 is stored, the stopper 94 returns to the return position (FIG. 8) by the elastic force of the compression coil spring 95, thereby preventing removal of the old plate 89. Reference numeral 96 denotes a guide which is brought into contact with the old plate 89 to direct it toward the loader 83.

A plate feed unit will be described below. An air cylinder 98 is pivotally supported on a bracket 97 fixed on each of the two side plates of the loader 83. A plurality of suction pads 100 connected to an air source (not shown) are formed on a bar 99 connected to the piston rod of the air cylinder 98 and extending in the widthwise direction of the loader 83. A plurality of new plates 102 are held between a guide plate 103 at the upper end portion of the loader 83 and plate reception plate 104 a the lower end portion of the loader 83 and are stacked on a guide plate 101 formed on the upper surface of the loader 83. Reference numeral 105 denotes a positioning reference pin which is fitted in a reference hole formed in each new plate 102. Reference numeral 106 denotes a new plate guide plate having grooves engaged with the suction pads 100 to move the suction pads 100 therealong. In the illustrated state, the suction pads 100 chuck the uppermost new plate 102, and the piston rod of each air cylinder 98 is moved forward. The leading edge of the new plate 102 is gripped by the leading-side plate lockup device 5 stopped so that the gripper surfaces are open on a line extending from the new plate 102.

An arm shaft 107 is pivotally supported on the lower end portion of the loader 83. Roller arms 108 are fixed on the two ends of the arm shaft 107 which extend from the loader 83. A plurality of press rollers 110 made of a plurality of rubber members or brushes and constituting a plate press unit together with the arm shaft 107 and the arms 108 are pivotally aligned on a shaft 109. A lever 115 is connected through a connecting plate 114 to the actuation end of a piston rod 113 of an air cylinder 112 fixed through a bracket 111 to one widthwise end of the loader 83. A free end of a lever 116 fixed to the arm shaft 107 is supported on the lower end of the lever 115. With this arrangement, when the piston rod 113 of the air cylinder 112 is moved forward, the arm 108 is pivoted between a storage position indicated by the solid line in FIG. 8 and an in-operation position indicated by the alternate long and short dashed line. In the in-operation position, the press rollers 110 are brought into tight contact with the new plate 102 on the plate cylinder 1 so as to bring this new plate 102 into tight contact with the circumferential surface of the plate cylinder 1. At the same time, the trailing-edge bent portion of the new plate 102 is inserted into the open trailing-side plate lockup device 30. A plurality of rollers 117 made of, e.g., rubber members or brushes are aligned on the arm shaft 107 and brought into slidable contact with the new plate 102 supplied to the leading-side plate lockup device 5 so as to guide the new plate to this plate lockup device. Reference numeral 118 denotes form rollers (generally four or more) of an inking apparatus which opposes the plate surface of the plate cylinder 1 to apply an ink thereto.

The plate lockup opening/closing drive unit, the loader drive unit, the old plate removal unit, the plate feed unit, and the plate holding unit are driven by a servo motor (not shown). The plate cylinder positioning unit including this servo motor and the above units are connected to a control unit (not shown). The pivotal movement of the plate cylinder and the operations of the respective units are performed at predetermined timings designated by an instruction from the control unit.

Figure 10A:
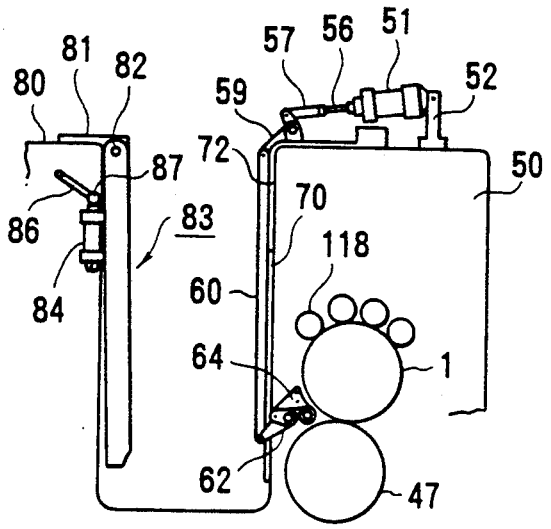
Figure 10B:
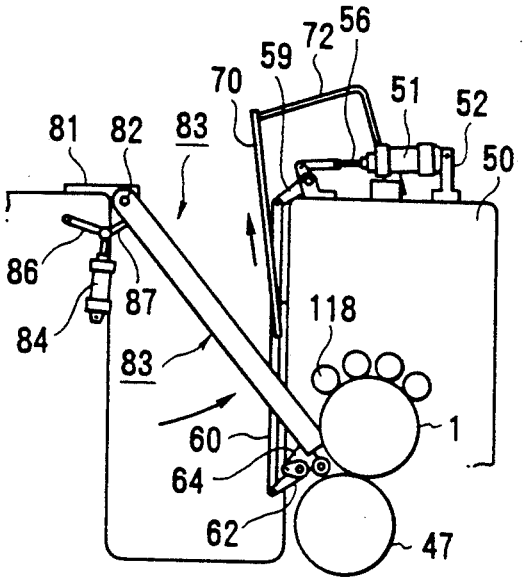

An operation of the plate replacing apparatus having the above arrangement will be described below. During printing, as shown in FIG. 10A, the loader 83 is suspended from the support shaft 82. In this state, the plurality of new plates 102 are sequentially stacked in an application order while being positioned by the reference pin 105 and are stored in the loader 83. When printing is completed and the old plate 89 is to be replaced with a new plate 102, a start button is depressed. The air cylinder 73 is actuated to open the cover 70 through the L-shaped lever 72, as indicated by the alternate long and short dashed line in FIG. 7. At the same time, the air cylinder 84 is arcuated to incline the loader 83 to a plate replacement position of FIG. 10B, through the levers 86 and 87. The servo motor is rotated to pivot the plate cylinder 1 by a predetermined angle to an angular position where the plate cylinder 1 is located at the plate removal position. At this time, when the right and left air cylinders 51 are simultaneously actuated, the lever 54 is urged by the right roller 67 to open the plate gripper surfaces of the trailing-side plate lockup device 30. At the same time, when the plate gripper surfaces of the trailing-side plate lockup device 30 are opened, the left lever 53A is urged by the left roller and is moved to the position indicated by reference numeral 53B, and the right lever 53 is moved from the position of the solid line to the position of the alternate long and short dashed line to open the plate gripper surfaces of the leading-side plate lockup device 5. Since the direction of the distal end of the right lever 54 is opposite to that of the distal end of the left lever 54A, when the right lever 54 is moved from the position of the alternate long and short dashed line to the position of the solid line in FIG. 9, the left lever 54A coaxial therewith is moved from the position indicated by reference numeral 54B to the position indicated by reference numeral 54A. When the left lever 53A is moved from the position indicated by reference numeral 53A to the position indicated by reference numeral 53B, the right lever 53 coaxial therewith is moved from the position of the solid line to the position of the alternate long and short dashed line. In this manner, the leading- and trailing-side plate lockup devices 5 and 30 are simultaneously opened at the stop position of the plate cylinder 1, and at the same time, the levers 53 and 54A return to the positions for closing the plate lockup devices 5 and 30. The suction pads 93 in the loader 83 has already been moved to the position indicated by the alternate long and short dashed line in FIG. 8 by the air cylinder 91.

Figure 10C:
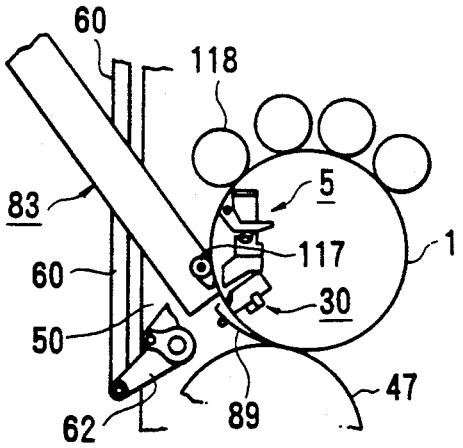
Figure 10D:
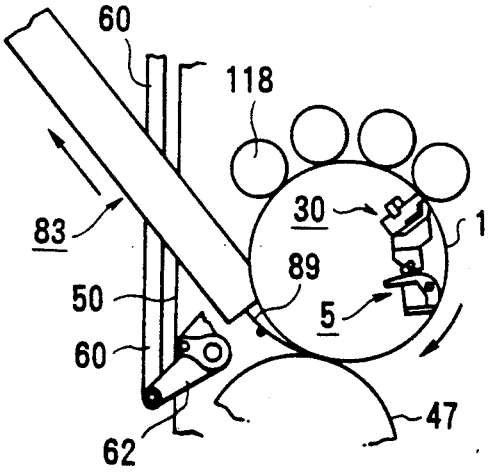

In this state, since the trailing edge of the old plate 89 popped up from the gripper surfaces abuts against the guide 96, and the plate cylinder 1 is rotated by a predetermined angle, as shown in FIG. 10C, the trailing edge of the old plate 89 is inserted between the guide plates 88 of the loader 83. When the central portion of the old plate 89 reaches the suction pads 93 located at the position of the alternate long and short dashed line, the suction pads 93 chuck the central portion. Since the suction pads 93 are moved upward at almost the same speed as the insertion speed of the old plate 89 upon operation of the air cylinder 91, the old plate 89 is moved upward and stored in the loader 83. After plate storage, the suction pads 93 return to the position of the alternate long and short dashed line so as to chuck the next old plate 89.

Figure 10E:
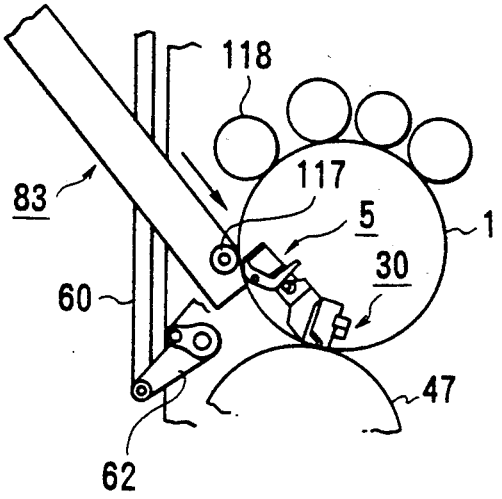

When the old plate is removed as described above, the servo motor is operated to slightly pivot the plate cylinder 1. The plate cylinder 1 is stopped at a position where the open plate gripper surfaces of the leading-side plate lockup 5 are located on a line extending from the new plate 102 held by the loader 83, as shown in FIG. 8. The suction pads 100 located at the position of the solid line in FIG. 8 are actuated to chuck the central portion of the uppermost new plate 102. The air cylinder 98 is operated to move the suction pads 100 downward together with the bar 99. The new plate 102 is moved downward and is inserted into the gripper surfaces of the open gripper surfaces of the leading-side plate lockup device 5. At this time, the lever 53 shown in FIG. 9 is located at the position of the alternate long and short dashed line and opposes the roller 67. When the air cylinder 51 is operated, the cam shaft 19 is rotated together with the lever 53 to close the leading-side plate lockup device 5. Therefore, the new plate 102 is gripped by the leading-side plate lockup device 5. FIG. 10E shows this state.

Figure 10F:
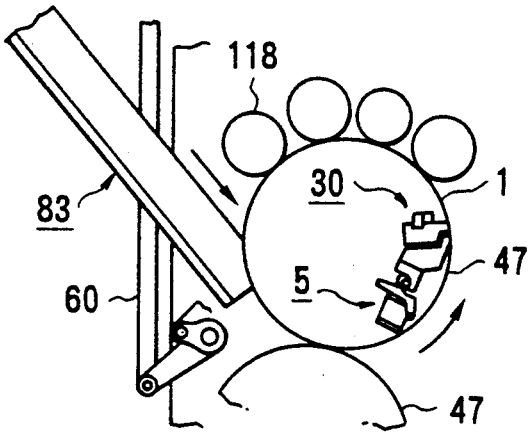
Figure 10G:
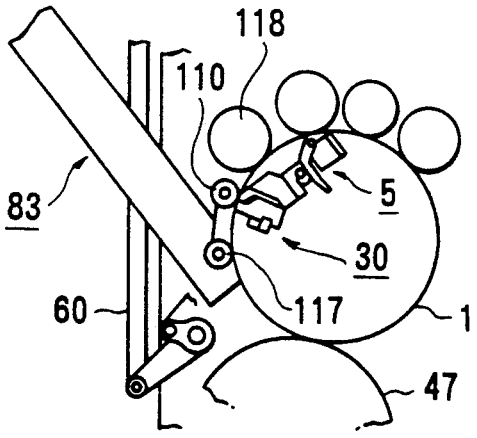

In this state, the servo motor is rotated to rotate the plate cylinder 1, and the new plate 102 is wound around the circumferential surface of the plate cylinder 1 and stopped at a position where the trailing-edge bent portion corresponds to the rollers 110. During a pivotal movement of the plate cylinder 1, since the rollers 117 are brought into tight and rolling contact with the new plate 102, the new plate 102 is brought into tight contact with the circumferential surface of the plate cylinder 1. Thereafter, the air cylinder 112 is operated to move the piston rod 113 backward. The arm 108 is pivoted through the levers 114, 115, and 116 to bring the brush-like rollers 110 into contact with the circumferential surface of the plate cylinder 1. The trailing-edge bent portion of the new plate 102 is inserted into the trailing-side plate lockup device 30 by the rollers 110. FIG. 10F shows a state wherein the plate cylinder 1 is being rotated, and FIG. 10G shows a state wherein rotation of the plate cylinder 1 is stopped. When the trailing edge of the plate 102 is inserted, the left air cylinder is operated. At this time, as described above, the lever 54A returns to the position indicated by reference numeral 54A, and the roller pushes the lever 54A upward. Upon a pivotal movement of the cam 38, the trailing-side plate lockup device 30 is closed to grip the insertion end of the new plate 102. At the end of pivotal movement of the cam 38, the gripper plates 36 and the lockup tables 35 become integral with each other and move together in the circumferential direction of the plate cylinder 1. The new plate 102 is thus kept taut and is brought into tight contact with the circumferential surface of the plate cylinder 1.

Figure 10H:
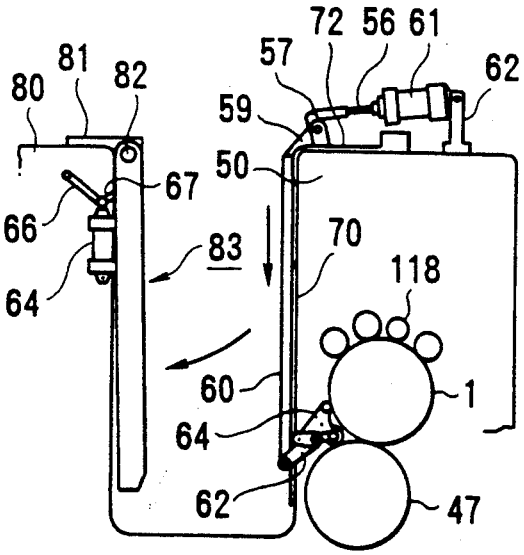

The piston rod 85 of the air cylinder 84 is moved backward to pull the levers 86 and 87. The loader 83 is moved downward to the stored state, as shown in FIG. 10H. The cover 70 is closed upon operation of the air cylinder 84. Therefore, printing can be restarted.

Figure 11:
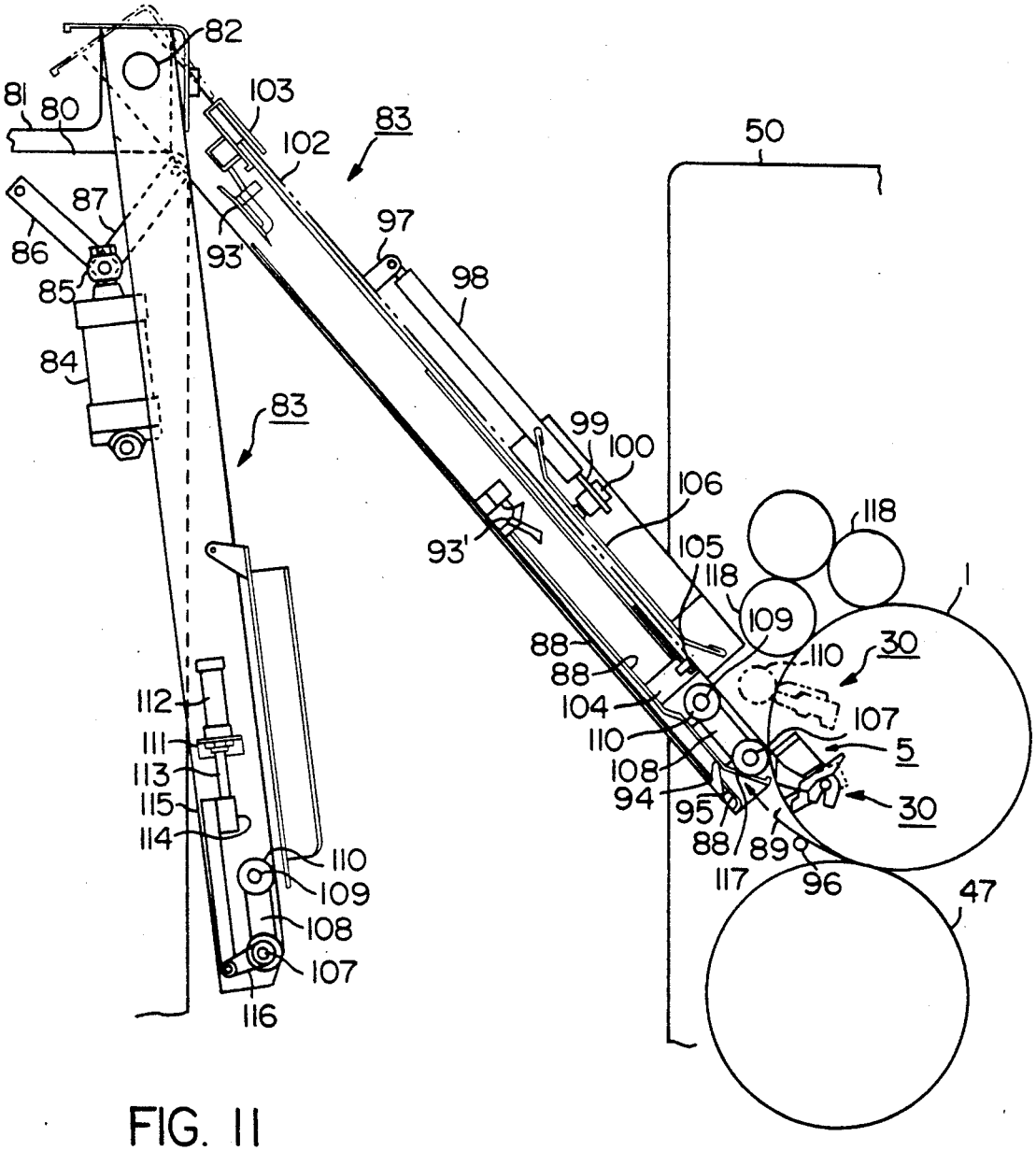
FIG. 11 is a side view of the plate exchange apparatus showing the use of plate engaging mechanisms for engaging the plates, which mechanism may take the form of either clamp members or an electromagnetic as an alternative to the use of the suction pads shown in FIG. 8.

The plate removal operation and the plate feed operation are repeated every time the specifications of the printed matters are repeated. These operations are continuously repeated without manual operations until the new plates 102 stored in the loader 83 are used up. The suction pads 93, 100 are used as plate engaging mechanisms for the old plate removal member and the new plate holding apparatus. As shown in FIG. 11, the plate engaging mechanism 93A, 100A, which may take the form of clamp members for clamping the plate or an electromagnetic for attracting the plate, are used to engage the old plate 89 entering between the guide plates 88 and are aligned on the bar 92 connected to the piston rods of the air cylinders 91. When the piston rod of each air cylinder 91 is reciprocated, the plate engaging mechanisms reciprocate between the illustrated solid line and the illustrated alternate long and shaft dashed line. The old plate 89 entering between the guide plates 88 is engaged at the position indicated by the alternate long and short dashed line and is moved to the position of the solid line, thereby storing the old plate 89 into the loader 83.

The above embodiment exemplifies an automatic plate replacing apparatus. However, the present invention is not limited to this. The plate lockup apparatus may be operated with a push button or the like.

The above embodiment exemplifies a sheet-fed printing press. However, the present invention is applicable to a web rotary printing press having similar plate fixing units.

According to the present invention, as is apparent from the above description, the plate exchange apparatus includes a plate holding apparatus for holding an old plate to be removed and a new plate to be supplied, an old plate removal member, arranged in a plate removal path of the old plate released from the fixing units and removed into the plate holding apparatus upon pivotal movement of the plate cylinder, for holding and moving the old plates one by one every plate replacement cycle and for stacking and storing the old plates in the plate holding apparatus, and a new plate holding apparatus for holding and moving the new plates stacked and stored in the plate holding apparatus and inserting each new plate into one fixing unit in an open state. The plate need not be manually held at the time of plate replacement. The labor can be reduced, plate replacement can be fully automatically performed, skills are not required, energy savings can be achieved, the preparation time can be shortened, and productivity can be improved. In addition, a plurality of unnecessary old plates and a plurality of necessary new plates are stored, and a plurality of plate replacement cycles can be repeatedly performed. Therefore, the preparation time can be further shortened, and the productivity can be further improved.

What is claimed is:

1. A plate replacing apparatus for a printing press having a first fixing unit provided on a plate cylinder for fixing one end of a plate and a second fixing unit provided on the plate cylinder for fixing another end of the plate wound around a circumferential surface of the plate cylinder, said first fixing unit and said second fixing unit being arranged in a gap on the circumferential surface of the plate cylinder, comprising:

a plate holding apparatus for holding both old plates removed from the plate cylinder and new plates to be supplied to the plate cylinder, means for moving said plate holding apparatus to come close to and be separated from the circumferential surface of the plate cylinder in a plate replacement cycle for replacement of the old plates with the new plates, said plate holding apparatus including, an old plate removal means arranged in a plate removal path of an old plate released from the second fixing unit for engaging and moving the old plate and storing the old plate in said plate holding apparatus; and a new plate holding means arranged in a plate mounting path of a new plate to be supplied to the first fixing unit for engaging and moving the new plate stacked and stored in said plate holding apparatus and mounting the new plate into the first fixing unit;

wherein the old plate removal means removes an old plate and the new plate holding means supplies a new plate during each plate replacement cycle when said plate holding unit comes close to said circumferential surface of said plate cylinder.

2. A plate replacing apparatus according to claim 1, wherein the old plate removal means and the new plate holding means each comprise pads for engaging the new plates and the old plates respectively and drive means for engaging and moving the old plates and the new plates respectively.

3. A plate replacing apparatus according to claim 1, wherein the old plate removal means and the new plate holding means each comprises an electromagnetic for engaging the new plates and the old plates respectively and drive means for engaging and moving the old plates and the new plates respectively.

4. A plate replacing apparatus according to claim 1, wherein the old plate removal means and the new plate holding means each comprises clamp members for engaging the new plates and the old plates respectively and drive means for engaging and moving the old plates and the new plates respectively.

* * * * *

UNITED STATES PATENT AND TRADEMARK OFFICE

CERTIFICATE OF CORRECTION

PATENT NO. : 5,218,907

DATED : Jun. 15, 1993

INVENTOR(S) : Komori et al.

It is certified that error appears in the above-indentified patent and that said Letters Patent is hereby corrected as shown below:

Column 1, lines 2 and 3, replace

"PLATE EXCHANGE APPARATUS FOR PRINTING PRESSCl BACKGROUND OF THE INVENTION"

by

-- PLATE EXCHANGE APPARATUS FOR PRINTING PRESS BACKGROUND OF THE INVENTION --

Signed and Sealed this

Nineteenth Day of September, 1995

*Attest:*

*Attesting Officer*

Bruce Lehman

BRUCE LEHMAN

*Commissioner of Patents and Trademarks*